US011426897B2

(12) United States Patent
Brown

(10) Patent No.: US 11,426,897 B2
(45) Date of Patent: Aug. 30, 2022

(54) KITS SUITABLE FOR CASTING CONCRETE ELEMENTS, AND METHODS FOR CASTING CONCRETE ELEMENTS USING SUCH KITS

(71) Applicant: Powers Brown Architecture Holdings, Houston, TX (US)

(72) Inventor: Jeffrey Brown, Houston, TX (US)

(73) Assignee: Powers Brown Architecture Holdings

( * ) Notice: Subject to any disclaimer, the term of this patent is extended or adjusted under 35 U.S.C. 154(b) by 203 days.

(21) Appl. No.: 16/721,362

(22) Filed: Dec. 19, 2019

(65) Prior Publication Data

US 2020/0199896 A1 Jun. 25, 2020

Related U.S. Application Data

(60) Provisional application No. 62/781,847, filed on Dec. 19, 2018.

(51) Int. Cl.

| | |
|---|---|
| ***B28B 7/02*** | (2006.01) |
| ***E04G 9/10*** | (2006.01) |
| ***E04G 11/06*** | (2006.01) |
| ***E04G 21/16*** | (2006.01) |

(52) U.S. Cl.

CPC ..... *B28B 7/025* (2013.01); *E04G 9/10* (2013.01); *E04G 11/062* (2013.01); *E04G 21/168* (2013.01)

(58) Field of Classification Search

CPC ..... E04G 11/062; E04G 11/06; E04G 9/10; E04G 9/01; E04G 9/04; E04G 9/05; E04G 9/06; E04G 11/32; E04G 21/168; B28B 7/025

USPC ..... 52/745.2

See application file for complete search history.

(56) References Cited

U.S. PATENT DOCUMENTS

| | | | | | |
|---|---|---|---|---|---|
| 1,327,481 | A * | 1/1920 | Kulow | E04G 11/062 | 249/17 |
| 1,773,454 | A * | 8/1930 | Fowler | E04G 11/32 | 425/123 |
| 3,182,948 | A * | 5/1965 | Lawrence | E04G 11/32 | 249/18 |
| 3,328,859 | A * | 7/1967 | Stevens | E04B 1/355 | 425/454 |
| 4,261,147 | A * | 4/1981 | Agsten | F28C 1/00 | 52/245 |

(Continued)

FOREIGN PATENT DOCUMENTS

| | | | | |
|---|---|---|---|---|
| CN | 108277973 | A * | 7/2018 | |
| DE | 2108473 | A1 * | 9/1972 | E04G 9/04 |

(Continued)

OTHER PUBLICATIONS

Translation for WO 2018178460 A1. (Year: 2018).*
Translation for JP-07251415 A. (Year: 1995).*

*Primary Examiner* — Michael Safavi

(74) *Attorney, Agent, or Firm* — Jonathan Pierce; Pierre Campanac; Porter Hedges LLP

(57) ABSTRACT

Buildings are constructed using the tilt-up technique from concrete elements that have contours that are at least partially curved. The concrete elements are made by casting in molds. The molds are assembled from mold pieces selected in a kit that contains a limited set of shapes. Molds assembled differently can produce concrete elements with a large variety of contour shapes.

18 Claims, 5 Drawing Sheets

(56) References Cited

U.S. PATENT DOCUMENTS

| | | | | | |
|---|---|---|---|---|---|
| 4,728,073 | A * | 3/1988 | Smith | E04G 9/06 | 249/10 |
| 6,247,677 | B1 * | 6/2001 | Vinet | B28B 7/0088 | 249/189 |
| 6,698,710 | B1 * | 3/2004 | VanderWerf | E02D 27/02 | 249/159 |
| 10,988,945 | B2 * | 4/2021 | Amato | E04G 9/10 | |
| 2009/0087621 | A1 * | 4/2009 | Vogel | E04C 1/40 | 428/156 |
| 2010/0078985 | A1 * | 4/2010 | Mahoney | B32B 5/022 | 297/446.1 |
| 2010/0117248 | A1 * | 5/2010 | Christiansen | E04G 9/02 | 264/31 |
| 2011/0265414 | A1 * | 11/2011 | Ciccarelli | E04B 2/8635 | 52/426 |
| 2017/0144869 | A1 * | 5/2017 | Helmuth | B66C 23/202 | |
| 2020/0018081 | A1 * | 1/2020 | Amato | E04G 13/00 | |

FOREIGN PATENT DOCUMENTS

| | | | | | |
|---|---|---|---|---|---|
| DE | 29507998 | U1 * | 2/1996 | E04G 11/062 | |
| EP | 0250730 | A1 * | 1/1988 | E04G 9/05 | |
| FR | 2181623 | A1 * | 12/1973 | E04B 1/355 | |
| FR | 2581111 | A1 * | 10/1986 | E04G 11/32 | |
| FR | 3047258 | A1 * | 8/2017 | B28B 23/028 | |
| GB | 1049861 | A * | 11/1966 | E04B 1/355 | |
| JP | 07251415 | A * | 10/1995 | B28B 7/025 | |
| JP | 2001212816 | A * | 8/2001 | | |
| KR | 101853717 | B1 * | 5/2018 | | |
| WO | WO-2010017608 | A1 * | 2/2010 | E04G 9/05 | |
| WO | WO-2018178460 | A1 * | 10/2018 | E04G 11/06 | |

* cited by examiner

KITS SUITABLE FOR CASTING CONCRETE ELEMENTS, AND METHODS FOR CASTING CONCRETE ELEMENTS USING SUCH KITS

CROSS-REFERENCE TO RELATED APPLICATIONS

This application claims the benefit of priority to provisional application Ser. No. 62/781,847, filed on Dec. 19, 2018, which is incorporated herein by reference in its entirety for all purposes.

BACKGROUND

This disclosure relates generally to apparatus and methods for constructing buildings using the tilt-up technique. This disclosure relates more specifically to kits suitable for casting concrete elements, and to methods for casting concrete elements using such kits.

Tilt-up, also referred to as tilt-slab or tilt-wall, is a known type of building and a construction technique using concrete. In the tilt-up technique, concrete elements (walls, panels, slabs, columns, structural supports, etc.) are cast horizontally on a surface located on the project site, usually provided by the building floor, and sometimes temporarily formed near the building footprint. After the concrete has cured, the elements are "tilted" to the vertical position with a crane and braced into position until the remaining building structural components (roofs, intermediate floors, and walls) are secured. Tilt-up eliminates the size limitation typically encountered in the prefabrication technique, which is imposed by the transportation of elements from a factory to the project site. Further, tilt-up is a cost-effective technique with a short completion time.

The contour of the mold in which the concrete elements are cast may be formed using lumber beams and/or aluminum extruded beams. As such, the concrete elements made with tilt-up have been limited to polygonal contours.

Therefore there is a continuing need in the art for kits for making molds that are suitable for casting concrete elements and that provide a variety of at least partially curved shapes and/or for methods for casting concrete elements and constructing buildings using such molds.

BRIEF SUMMARY OF THE DISCLOSURE

The disclosure describes a kit for making molds. The molds are suitable for casting concrete elements.

The kit comprises a plurality of mold pieces. Each of the plurality of mold pieces may be shaped essentially as a surface extruded from a first end, along a circular arc, and to a second end. The first end of any mold piece may be capable of being releasably interlocked to the second end of any other mold piece. For example, the first end of all mold pieces may include a tail of a dovetail joint, and the second end of all mold pieces includes a pin of the dovetail joint. The tail and the pin may be designed for releasably interlock with one another.

Preferably, some of the plurality of mold pieces may be shaped as the surface extruded along a circular arc, having a radius of approximately thirty inches. Others of the plurality of mold pieces may be shaped as the surface extruded along a circular arc, having a radius of preferably sixty inches. Yet others of the plurality of mold pieces may be shaped as the surface extruded along a circular arc having a radius of preferably ninety inches. All the plurality of mold pieces may be shaped as the surface extruded along a circular arc that subtends an arc of forty-five degrees.

The disclosure describes a method for casting concrete elements. The method comprises the steps of selecting mold pieces from the kit described herein, assembling the selected mold pieces on a horizontal surface, pouring fresh concrete into the mold, and curing the fresh concrete to form a concrete element.

The disclosure describes a method for constructing a building. The method comprises the steps of casting concrete elements as described herein and tilting the concrete element up after the concrete is cured.

BRIEF DESCRIPTION OF THE DRAWINGS

For a more detailed description of the embodiments of the disclosure, reference will now be made to the accompanying drawings, wherein.

DETAILED DESCRIPTION

It is to be understood that the following disclosure describes several exemplary embodiments for implementing different features, structures, or functions of the invention. Exemplary embodiments of components, arrangements, and configurations are described below to simplify the disclosure; however, these exemplary embodiments are provided merely as examples and are not intended to limit the scope of the invention.

Figure 1A:
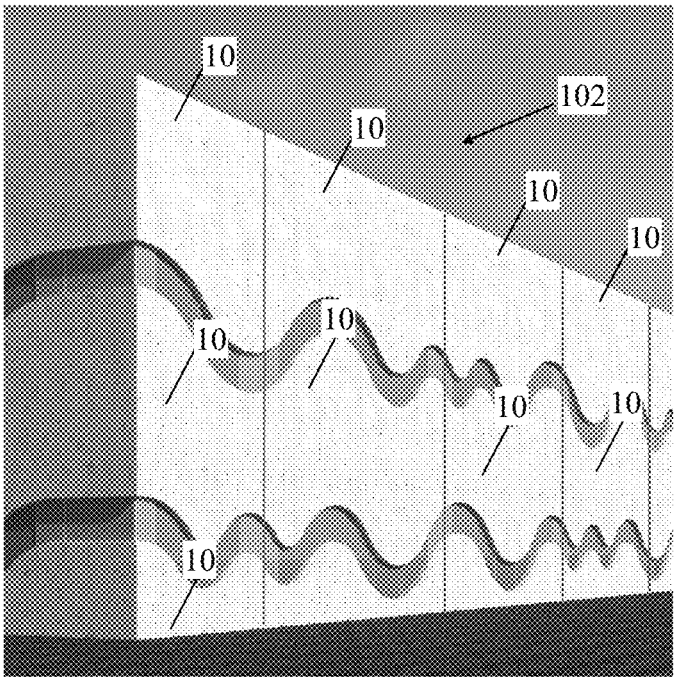
FIG. 1A is a perspective view of a building constructed from concrete elements that have a bottom and/or top contours that are at least partially curved.
Figure 1B:
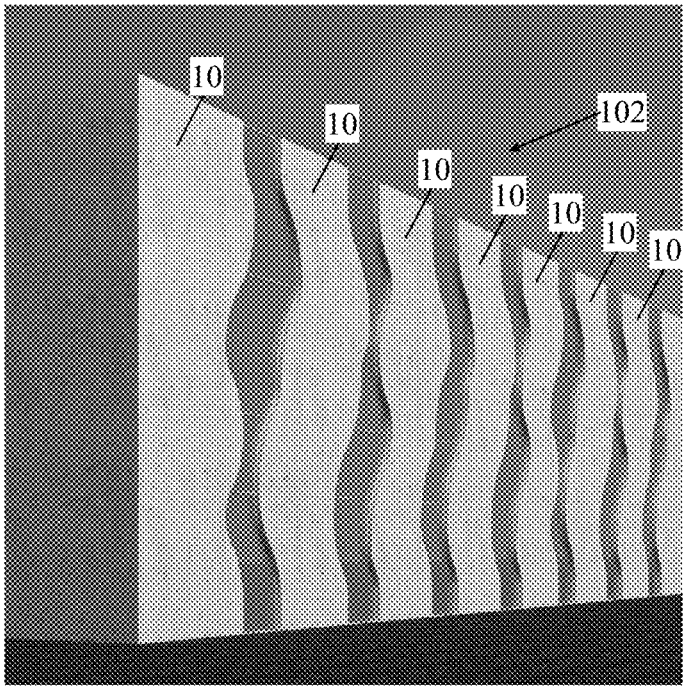
FIG. 1B is a perspective view of a building constructed from concrete elements that have side contours that are at least partially curved.

The disclosure describes methods for constructing buildings 102, such as illustrated in FIGS. 1A and 1B, using the tilt-up technique. The buildings 102 are constructed from concrete elements 10 (e.g., concrete walls or panels). In the example of FIG. 1A, the concrete elements 10 have a bottom and/or top contours that are at least partially curved. In the example of FIG. 1B, the concrete elements 10 have side contours that are at least partially curved. FIGS. 1A and 1B are not intended to be limiting examples of buildings 102 that can be constructed using the disclosed methods.

Figure 2:
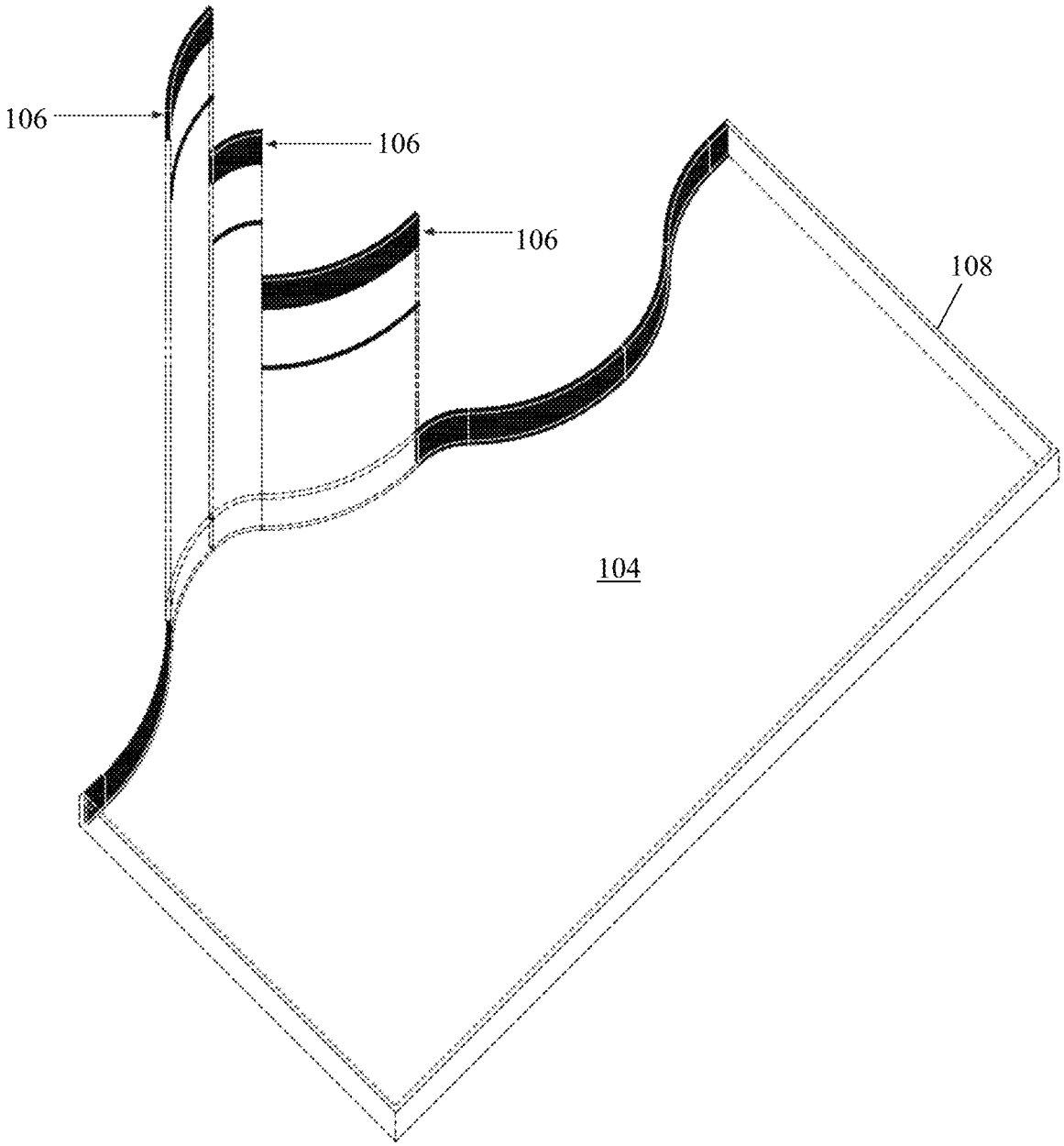
FIG. 2 is a perspective view of a mold formed by mold pieces selected from a kit that contains a limited set of shapes.

In the disclosed methods, the concrete elements 10 are made by casting. Accordingly, the disclosed methods comprise the steps of selecting mold pieces 106 from a kit that contains a limited set of mold pieces and assembling the selected mold pieces 106 on a horizontal surface 104 to form a mold 108, as is illustrated in FIG. 2. In some embodiments, the mold pieces 106 may be made by 3D printing, and/or may be made by stainless steel. The disclosed methods may also comprise the steps of pouring fresh concrete into the mold 108, curing the fresh concrete to form a concrete element 10 (shown in FIGS. 1A and 1B), and tilting the concrete element 10 up after the concrete is cured in order to construct a building.

Figure 3:
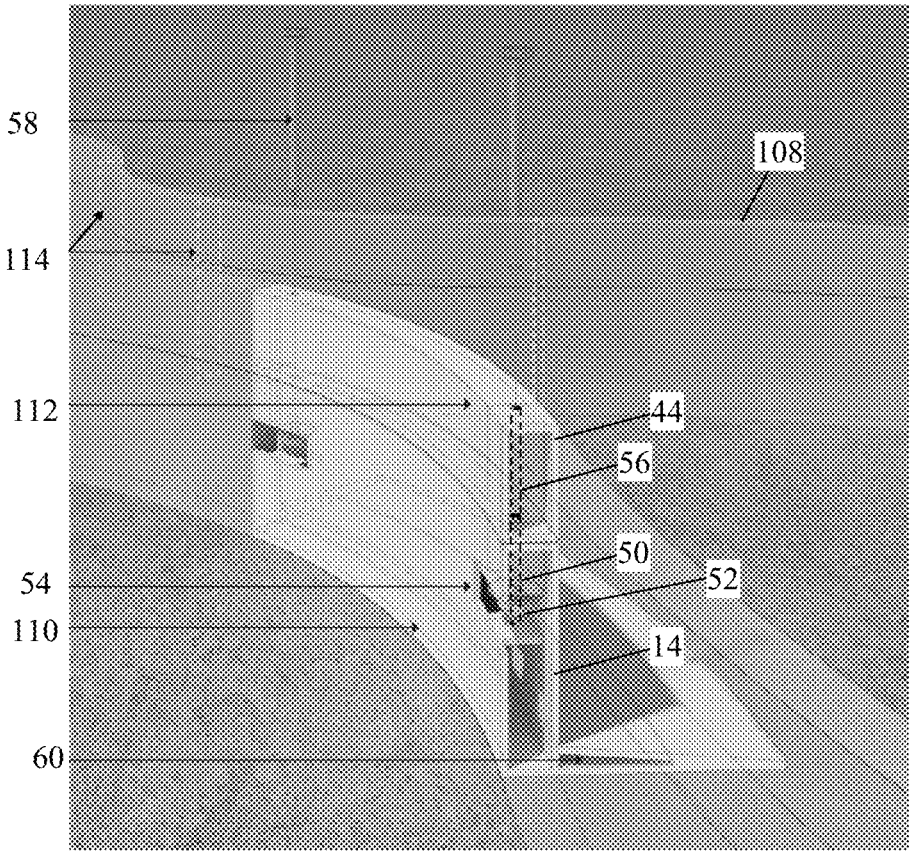
FIG. 3 is a perspective view, partially in cross section, of a mold formed by mold pieces selected from a kit that contains a limited set of shapes.

Referring to FIG. 3, the mold pieces 106 may comprise base mold pieces 110, and optional extension mold pieces 112. For example, the base mold pieces 110 may be used for making molds 108 suitable for casting concrete elements 10 up to eight inches thick. For casting concrete elements 10 thicker than eight inches, the base mold pieces 110 and corresponding extension mold pieces 112 may be stacked along the height direction. For example, the stacks of base mold pieces 110 and extension mold pieces 112 may be suitable for casting concrete elements 10 up to twelve inches thick. In the embodiment illustrated in FIG. 3, the extension mold pieces 112 are releasably secured to the base mold pieces 110 using one or more bolts 58 sized to engage the one or more nuts 52. Accordingly, each of the base mold pieces 110 may comprise one or more blind holes 50 provided along the height of each of the base mold pieces 110; each of the extension mold pieces 112 may comprise one or more thru-holes 56 provided along the height of each of the extension mold pieces 112; the one or more thru-holes 56 are aligned with the axis of the one or more blind holes 50 when corresponding base mold pieces 110 and extension mold pieces 112 are stacked along the height direction. Each of the one or more nuts 52 may be secured to a cross-longitudinal rib 54 located along the axis of the one or more blind holes 50. Other securing mechanisms may be used instead of the one or more bolts 58 and the one or more nuts 52.

Optionally, the base mold pieces 110 may comprise a flange 60 on one side of some or all of the base mold pieces 110. The flange 60 may prevent the base mold pieces 110 from overturning under pressure applied by fresh concrete inside the mold 108. The flange 60 may optionally be detachable from the base mold pieces 110.

The base mold pieces 110 may essentially be shaped as a first surface 14 extruded from their respective first ends 16, along specific curves, to their respective second ends 20, although the fabrication of the base mold pieces may not involve extrusion. For example, the first surface 14 may be a trapezoid or an oblong rectangle. Examples of specific curves along which the first surface 14 is extruded are discussed in the description of FIG. 5. Similarly, the extension mold pieces 112 may essentially be shaped as a second surface 44 extruded from their respective first ends 16, along the same specific curves, to their respective second ends 20. For example, the second surface 44 may be a right trapezoid or an oblong rectangle.

Figure 4:
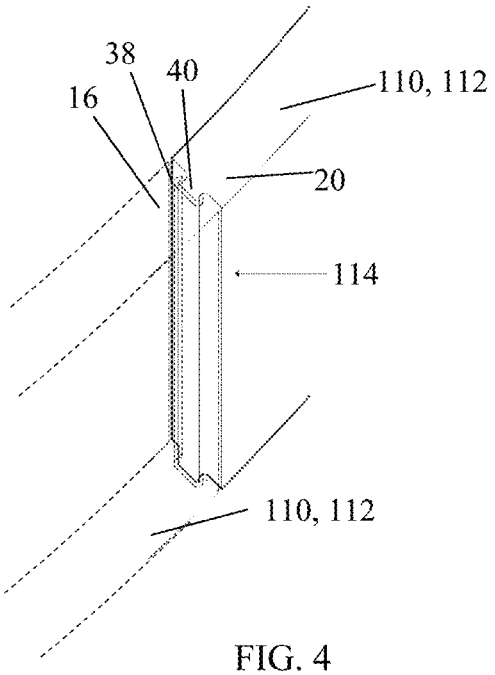
FIG. 4 is a perspective view of an interlock mechanism between two mold pieces.

In reference to FIGS. 3 and 4, the first end 16 of one of the base mold pieces 110 (in ghost lines) includes a tail 38 of a dovetail joint 114; the second end 20 of another of the base mold pieces 110 (in solid lines) includes a pin 40 of the dovetail joint 114; the pin 40 is designed for releasably interlock with the tail 38 of the dovetail joint 114 after sliding in the vertical direction. Similarly, the first end 16 of one of the extension mold pieces 112 (in solid lines) may optionally include a tail 38 of a dovetail joint 114; the second end 20 of another of the extension mold pieces 112 (in ghost lines) may optionally include a pin 40 of the dovetail joint 114. However, it may be sufficient to provide an interlock mechanism only on the base mold pieces 110. Other interlock mechanisms may be used instead of the tail 38 and the pin 40. For example, another interlock mechanism may include a part that includes two opposite tails for forming two dovetail joints by coupling to a pin formed on the first end of one of the base mold pieces as well as to a pin formed on the second end of another of the base mold pieces.

Figure 5:
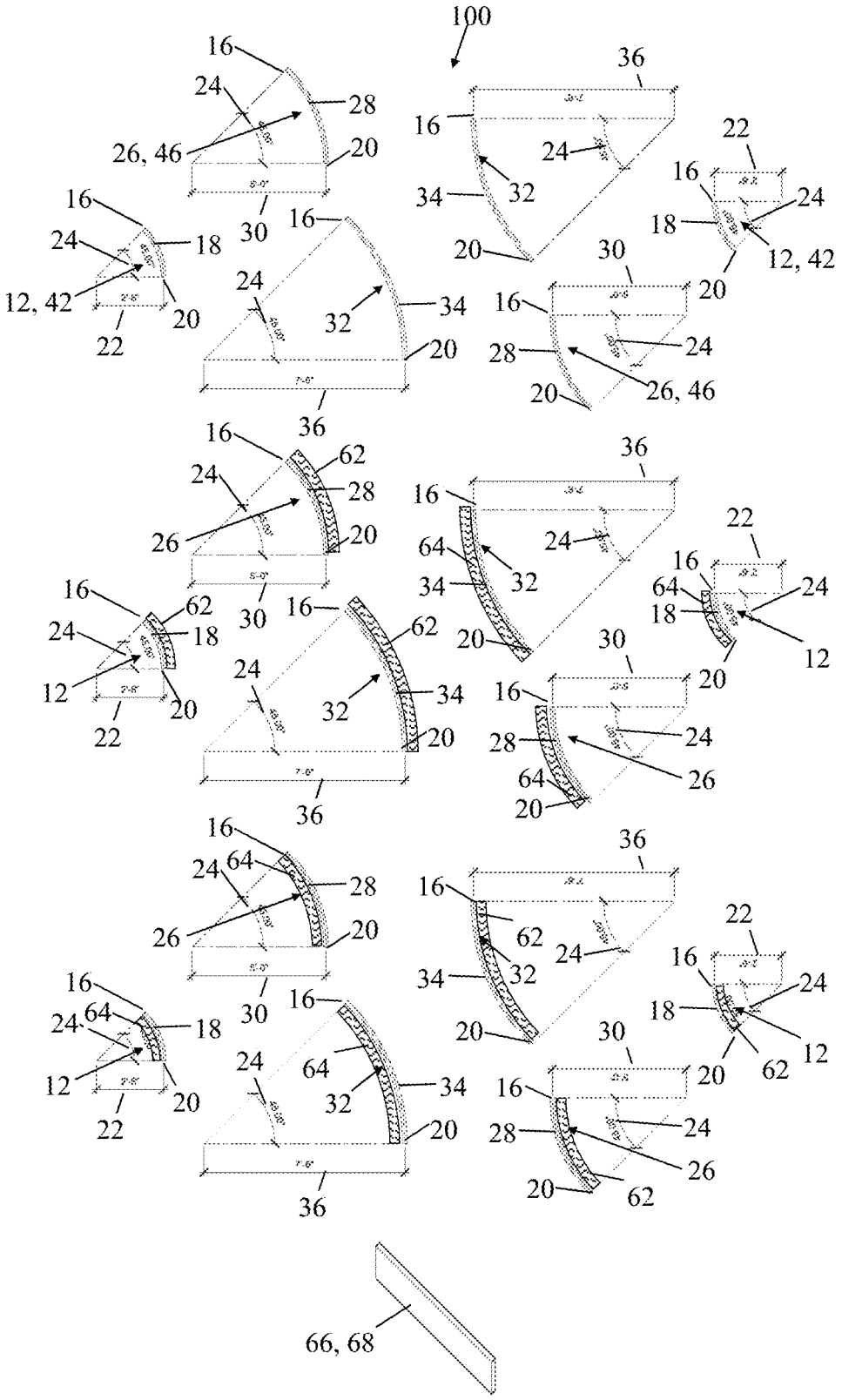
FIG. 5 is a schematic of a kit that contains a limited set of shapes.

In reference to FIG. 5, an example of a representative portion of a kit 100 is illustrated. The kit 100 is usable for making molds 108 (such as shown in FIGS. 2, 3) that are suitable for casting concrete elements 10 (such as shown in FIG. 1A, 1B). The kit 100 may comprise a first plurality of base mold pieces 12, each of the first plurality of base mold pieces 12 being shaped essentially as the first surface 14 as described in reference to FIG. 3, extruded from a first end 16, along a first circular arc 18, and to a second end 20, wherein the first circular arc 18 has a first radius 22 and subtends an angle 24. The kit 100 may comprise a second plurality of base mold pieces 26, each of the second plurality of base mold pieces 26 being shaped essentially as the first surface 14 extruded from a first end 16, along a second circular arc 28, and to a second end 20, wherein the second circular arc 28 has a second radius 30 and preferably subtends the same angle 24. The kit 100 may comprise a third plurality of base mold pieces 32, each of the third plurality of base mold pieces 32 being shaped essentially as the first surface 14 extruded from a first end 16, along a third circular arc 34, and to a second end 20, wherein the third circular arc 34 has a third radius 36 and preferably subtends the same angle 24. The first radius, the second radius, and the third radius are substantially different. For example, in the example illustrated in FIG. 5, the first radius 22 is approximately thirty inches; the second radius 30 is approximately twice the first radius 22; the third radius 36 is approximately thrice the first radius 22. The angle 24 of approximately sixty degrees or less, and is preferably an integer fraction of three hundred and sixty degrees, such as sixty degrees, forty-five degrees, thirty-six degrees, or thirty degrees.

In some embodiments, the kit 100 may comprise a first plurality of extension mold pieces 42, each of the first plurality of extension mold pieces 42 being shaped essentially as a second surface 44 as described in reference to FIG. 3, extruded from a first end 16, along the first circular arc 18, and to a second end 20. The kit 100 may comprise a second plurality of extension mold pieces 46, each of the second plurality of extension mold pieces 46 being shaped essentially as the second surface 44 extruded from a first end 16, along the second circular arc 28, and to a second end 20. The kit 100 may comprise a third plurality of extension mold pieces 48, each of the third plurality of extension mold pieces 48 being shaped essentially as the second surface 44 extruded from a first end 16, along the third circular arc 34, and to a second end 20.

Further, the first end 16 of all of the first plurality of base mold pieces 12, the second plurality of base mold pieces 26, the third plurality of base mold pieces 32, and optionally, the first plurality of extension mold pieces 42, the second plurality of extension mold pieces 46, the third plurality of extension mold pieces 48, may include the tail 38 of the dovetail joint 114 as described in reference to FIG. 4; the second end 20 of all of the first plurality of base mold pieces 12, the second plurality of base mold pieces 26, and the third plurality of base mold pieces 32 may include the pin 40 of the dovetail joint 114 as described in reference to FIG. 4. In such cases illustrated in FIG. 5, the kit 100 may comprise right-curved mold pieces when looking from the first end 16 toward the second end 20, as well as left-curved mold pieces (also when looking from the first end 16 toward the second end 20).

Still further, each of the first plurality of extension mold pieces 42, the second plurality of extension mold pieces 46, and third plurality of extension mold pieces 48 may comprise one or more blind holes 50 provided along the height of the first surface 14 and one or more corresponding nuts 52 secured to a cross-longitudinal rib 54 located along the axis of the one or more blind holes 50, as described in reference to FIG. 3. Each of the first plurality of extension mold pieces 42, second plurality of extension mold pieces 46, and third plurality of extension mold pieces 48 comprises one or more thru-holes 56 provided along the height of the second right trapezoid 44 and aligned with the axis of the one or more blind holes 50 when corresponding base mold pieces 12 and extension mold pieces are stacked along the height direction, as described in reference to FIG. 3. The kit 100 may comprise one or more bolts 58 sized to engage the one or more nuts 52.

In the example illustrated in FIG. 5, some of the first plurality of base mold pieces 12, the second plurality of base mold pieces 26 and the third plurality of base mold pieces 32 includes a left-sided flange 62 (also when looking from the first end 16 toward the second end 20). Conversely, some of the first plurality of base mold pieces 12, the second plurality of base mold pieces 26, and the third plurality of base mold pieces 32 include a right-sided flange 64. Depending on the side of the mold pieces where the fresh concrete is poured, either a left-sided flange 62 or a right-sided flange 64 may be used.

The kit 100 may also comprise a plurality of base mold pieces 66, and optionally a plurality of extension mold pieces 68, that are straight and can interlock with other mold pieces of the kit 100.

Figure 6A:
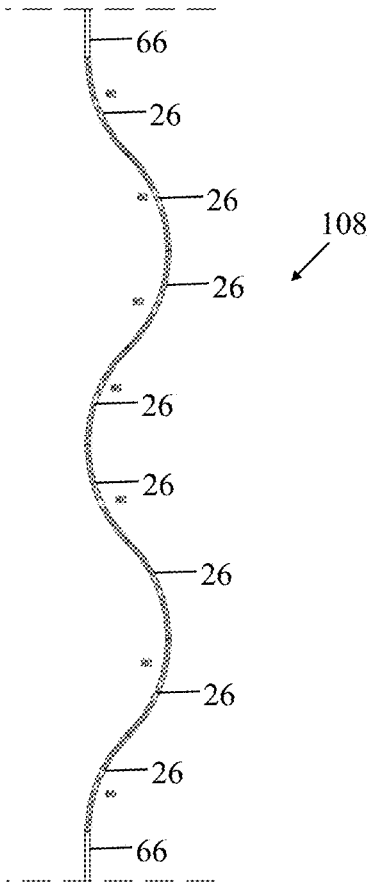
FIGS. 6A-6D are planar views of mold shapes that may be obtained using mold pieces of the kit shown in FIG. 5.
Figure 6B:
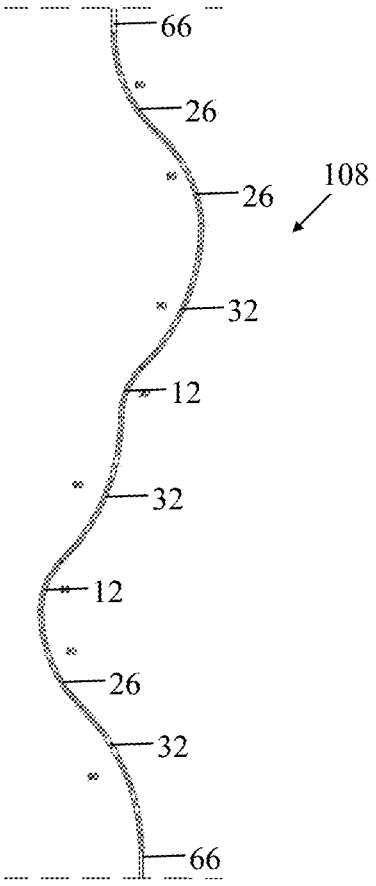
Figure 6C:
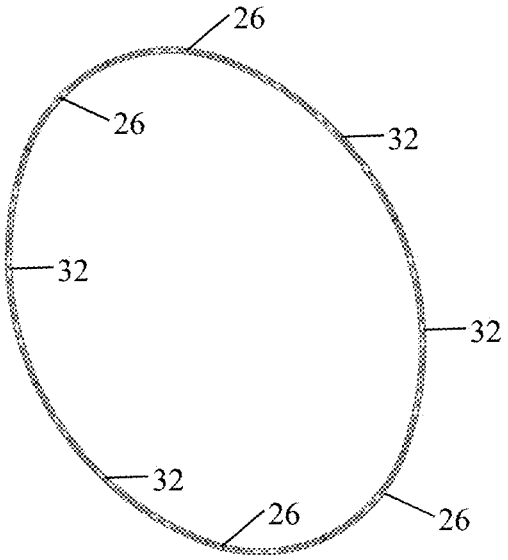
Figure 6D:
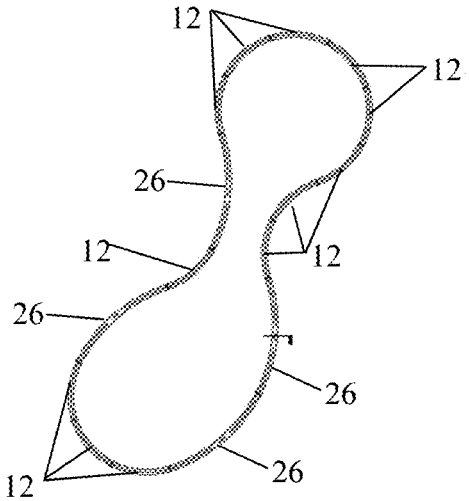

FIGS. 6A and 6B illustrate example uses of the kit 100 shown in FIG. 5 to make a contour portion or side of a mold 108. FIGS. 6C and 6D illustrate example uses of the kit 100 shown in FIG. 5 to make a contour entirety of a mold 108. In these examples, the mold 108 can be used to contain the fresh concrete in the interior of the mold. Alternatively, the mold 108 can be used to contain the fresh concrete in the exterior of the mold, such that the mold 108 is used to provide a curved hole in the concrete element 10. FIGS. 6A, 6B, 6C, and 6D are not intended to be limiting examples of uses of the kit 100.

All numerical values in this disclosure may be approximate values unless otherwise specifically stated. Accordingly, various embodiments of the disclosure may deviate from the numbers, values, shapes, and ranges disclosed herein without departing from the intended scope.

As used herein, a mold piece is shaped essentially as a reference shape when the distance between the surface of the mold piece and the surface of the reference shape is less than 10% of the length of the reference shape. For example, a mold piece shaped as an elliptical arc, a parabolic arc, a spiral arc, a cycloid arc, or a similar curve would be shaped essentially as a circle when a reference circular arc can be overlaid on the elliptical mold piece, and the distance between the surface of the elliptical mold piece and the reference circular arc is less than 10% of the length of the reference circular arc.

As used herein, a distance, an angle, a length, a radius, or other measurement is approximately the same as a reference if said distance, said angle, . . . has a value that differs from the reference by less than 10%. Conversely, a distance, an angle, or other measurement is substantially different from a reference if said distance, said angle, . . . has a value that differs from the reference by more than 10%.

What is claimed is:

1. A method for casting concrete elements, comprising:
selecting mold pieces from a kit;
assembling the selected mold pieces on a horizontal surface to form a mold having contours that are at least partially curved;
pouring fresh concrete into the mold; and
curing the fresh concrete to form a concrete element,
wherein the kit comprises:
a first plurality of mold pieces, each of the first plurality of mold pieces being shaped essentially as a surface extruded from a first end, along a first circular arc, and to a second end, wherein the first circular arc has a first radius and subtends a first angle;
a second plurality of mold pieces, each of the second plurality of mold pieces being shaped essentially as the surface extruded from a first end, along a second circular arc, and to a second end, wherein the second circular arc has a second radius and subtends a second angle;
a third plurality of mold pieces, each of the third plurality of mold pieces being shaped essentially as the surface extruded from a first end, along a third circular arc, and to a second end, wherein the third circular arc has a third radius and subtends a third angle; and
one or more mold pieces that are straight;
wherein the first radius, the second radius, and the third radius are substantially different, and
wherein the first end of any mold piece is configured for being releasably interlocked with the second end of any other mold piece.

2. The method of claim 1, wherein the second radius is approximately twice the first radius, and the third radius is approximately thrice the first radius.

3. The method of claim 2, wherein the first radius is approximately thirty inches.

4. The method of claim 1, wherein the first angle, the second angle, and the third angle are essentially the same.

5. The method of claim 4, wherein the first angle, the second angle, and the third angle are an integer fraction of three hundred and sixty degrees that is equal to or less than sixty degrees.

6. The method of claim 1, wherein the first end of all mold pieces includes a tail of a dovetail joint, and the second end of all mold pieces includes a pin of the dovetail joint, wherein the tail and the pin are designed for releasably interlock with one another.

7. A method for constructing a building, comprising:
selecting mold pieces from a kit;
assembling the selected mold pieces on a horizontal surface to form a mold having contours that are at least partially curved;
pouring fresh concrete into the mold;
curing the fresh concrete to form a concrete element; and
tilting the concrete element up after the concrete is cured,
wherein the kit comprises:
a first plurality of mold pieces, each of the first plurality of mold pieces being shaped essentially as a surface extruded from a first end, along a first circular arc, and to a second end, wherein the first circular arc has a first radius;
a second plurality of mold pieces, each of the second plurality of mold pieces being shaped essentially as the surface extruded from a first end, along a second circular arc, and to a second end, wherein the second circular arc has a second radius;
a third plurality of mold pieces, each of the third plurality of mold pieces being shaped essentially as the surface extruded from a first end, along a third circular arc, and to a second end, wherein the third circular arc has a third radius; and one or more mold pieces that are straight;

wherein the first radius, the second radius, and the third radius are substantially different, and wherein the first end of any mold piece is configured for being releasably interlocked with the second end of any other mold piece.

8. The method of claim 7, wherein the second radius is approximately twice the first radius, and the third radius is approximately thrice the first radius.

9. The method of claim 8, wherein the first radius is approximately thirty inches.

10. The method of claim 7, wherein the first circular arc subtends a first angle, wherein the second circular arc subtends a second angle, wherein the third circular arc subtends a third angle, and wherein the first angle, the second angle, and the third angle are essentially the same.

11. The method of claim 10, wherein the first angle, the second angle, and the third angle are an integer fraction of three hundred and sixty degrees that is equal to or less than sixty degrees.

12. The method of claim 7, wherein the first end of all mold pieces includes a tail of a dovetail joint, and the second end of all mold pieces includes a pin of the dovetail joint, wherein the tail and the pin are designed for releasably interlock with one another.

13. A system for making molds suitable for casting concrete elements having contours that are at least partially curved, comprising:

a first plurality of mold pieces, each of the first plurality of mold pieces being shaped essentially as a surface extruded from a first end, along a first circular arc, and to a second end, wherein the first circular arc has a first radius;

a second plurality of mold pieces, each of the second plurality of mold pieces being shaped essentially as the surface extruded from a first end, along a second circular arc, and to a second end, wherein the second circular arc has a second radius;

a third plurality of mold pieces, each of the third plurality of mold pieces being shaped essentially as the surface extruded from a first end, along a third circular arc, and to a second end, wherein the third circular arc has a third radius; and one or more mold pieces that are straight;

wherein the first radius, the second radius, and the third radius are substantially different, and wherein the first end of any mold piece is configured for being releasably interlocked with the second end of any other mold piece.

14. The system of claim 13, wherein the second radius is approximately twice the first radius, and the third radius is approximately thrice the first radius.

15. The system of claim 14, wherein the first radius is approximately thirty inches.

16. The system of claim 13, wherein the first circular arc subtends a first angle, wherein the second circular arc subtends a second angle, wherein the third circular arc subtends a third angle, and wherein the first angle, the second angle, and the third angle are essentially the same.

17. The system of claim 16, wherein the first angle, the second angle, and the third angle are an integer fraction of three hundred and sixty degrees that is equal to or less than sixty degrees.

18. The system of claim 13, wherein the first end of all mold pieces includes a tail of a dovetail joint, and the second end of all mold pieces includes a pin of the dovetail joint, wherein the tail and the pin are designed for releasably interlock with one another.

* * * * *